US008432244B2

(12) United States Patent
Hosokawa et al.

(10) Patent No.: US 8,432,244 B2
(45) **Date of Patent: *Apr. 30, 2013**

(54) POWER DISTRIBUTION TRANSFORMER AND TANK THEREFOR

(75) Inventors: Masao Hosokawa, Tainai (JP); Mitsuaki Kawashima, Tainal (JP); Kazuyuki Fukui, Tainai (JP); Kouji Yamashita, Nagareyama (JP); Izumi Muto, Hikari (JP); Eiichiro Ishimaru, Hikari (JP); Hiroshige Inoue, Futtsu (JP)

(73) Assignees: Hitachi Industrial Equipment Systems Co., Ltd., Tokyo (JP); Nippon Steel & Sumikin Stainless Steel Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/402,655

(22) Filed: Feb. 22, 2012

(65) Prior Publication Data

US 2012/0146754 A1 Jun. 14, 2012

Related U.S. Application Data

(60) Continuation of application No. 12/915,092, filed on Oct. 29, 2010, now Pat. No. 8,143,985, which is a division of application No. 11/313,830, filed on Dec. 22, 2005, now Pat. No. 7,843,298.

(30) Foreign Application Priority Data

Dec. 27, 2004 (JP) ..... 2004-375208

(51) Int. Cl.
*H01F 27/02* (2006.01)

(52) U.S. Cl.
USPC ..... 336/90

(58) Field of Classification Search ..... 336/57, 336/58, 90, 92, 94
See application file for complete search history.

(56) References Cited

U.S. PATENT DOCUMENTS

| | | | |
|---|---|---|---|
| 2,768,915 | A | 10/1956 | Nachman et al. |
| 2,858,350 | A | 10/1958 | Fritts et al. |
| 3,644,658 | A | 2/1972 | Kuti |
| 3,700,432 | A | 10/1972 | Brickner |

(Continued)

FOREIGN PATENT DOCUMENTS

| | | |
|---|---|---|
| CN | 86101805 | 8/1986 |
| CN | 1310771 | 8/2001 |

(Continued)

OTHER PUBLICATIONS

Tanaka Review, vol. 36-1, No. 119, Mar. 1989, p. 46.

(Continued)

*Primary Examiner* — Mohamad Musleh
*Assistant Examiner* — Joselito Baisa
(74) *Attorney, Agent, or Firm* — Antonelli, Terry, Stout & Kraus, LLP.

(57) ABSTRACT

Disclosed is a power distribution transformer having a body of the transformer, the body consisting of a coil and an iron core; a tank containing the body of the transformer and an insulation substance which fills an inner space of the tank; and an upper lid of the tank. The tank and/or the upper lid is made of a ferritic stainless steel.

22 Claims, 5 Drawing Sheets

U.S. PATENT DOCUMENTS

| | | | | | |
|---|---|---|---|---|---|
| 4,176,333 | A | * | 11/1979 | Bennon et al. | 336/60 |
| 4,196,408 | A | | 4/1980 | Link | |
| 4,374,638 | A | | 2/1983 | Presser | |
| 4,453,197 | A | | 6/1984 | Burrage | |
| 4,465,525 | A | * | 8/1984 | Yoshimura et al. | 420/40 |
| 4,552,719 | A | * | 11/1985 | Morimoto et al. | 419/2 |
| 4,656,450 | A | | 4/1987 | Jarosz | |
| 4,690,798 | A | | 9/1987 | Narutani et al. | |
| 4,745,966 | A | * | 5/1988 | Avery | 165/104.33 |
| 4,964,926 | A | | 10/1990 | Hill | |
| 5,122,926 | A | | 6/1992 | Lev | |
| 5,126,926 | A | | 6/1992 | Chiang Wen | |
| 5,273,246 | A | | 12/1993 | Stahara et al. | |
| 5,527,988 | A | | 6/1996 | Hernandez et al. | |
| 5,587,554 | A | | 12/1996 | Kendrick, Jr. | |
| 5,736,915 | A | * | 4/1998 | Goedde et al. | 336/55 |
| 6,398,986 | B1 | | 6/2002 | McShane et al. | |
| 6,588,494 | B1 | * | 7/2003 | Mazurier et al. | 164/476 |
| 6,770,067 | B2 | | 8/2004 | Lorenzen et al. | |
| 6,905,638 | B2 | | 6/2005 | Corkran et al. | |
| 7,396,353 | B2 | | 7/2008 | Lorenzen | |
| 2003/0183292 | A1 | | 10/2003 | Otsuka | |

FOREIGN PATENT DOCUMENTS

| | | |
|---|---|---|
| CN | 1678766 | 10/2005 |
| JP | 53-102239 | 9/1978 |
| JP | 59-151921 | 8/1984 |
| JP | 61-051807 | 3/1986 |
| JP | 61-138005 | 6/1986 |
| JP | 63-6303 | 1/1988 |
| JP | 04-009276 | 1/1992 |
| JP | 06-011193 | 1/1994 |
| JP | 07-263245 | 10/1995 |
| JP | 08-260106 | 10/1996 |
| JP | 09-282984 | 10/1997 |
| JP | 09-291345 | 11/1997 |
| JP | 11-279716 | 10/1999 |
| JP | 11-354353 | 12/1999 |
| JP | 2000-139007 | 5/2000 |
| JP | 2001-011582 | 1/2001 |
| JP | 2002-060973 | 2/2002 |
| JP | 2002-105605 | 4/2002 |
| JP | 2002-129292 | 5/2002 |
| JP | 2002-211255 | 7/2002 |
| JP | 2002-363695 | 12/2002 |
| JP | 2003-231954 | 8/2003 |
| JP | 2003-277992 | 10/2003 |
| JP | 2004-006241 | 1/2004 |
| JP | 2004-068118 | 3/2004 |
| JP | 2004-115911 | 4/2004 |
| JP | 2004-210003 | 7/2004 |
| JP | 2004-343033 | 12/2004 |
| JP | 2006-184053 | 7/2006 |

OTHER PUBLICATIONS

Chinese Office Action dated Jul. 9, 2010 with translation.

Kawaguchi, Current Advances in Materials and Processes, vol. 9, No. 6, p. 1287, Sep. 1996 Atmospheric Corrosion Characteristics of Phosphated Galvanized Stainless Steel Sheet.

Kawaguchi, Rust Prevention & Control, vol. 42, No. 2, p. 55-59, Feb. 1998, Tone and Weathering Resistance of Phosphating Hot Dip Galvanizing Stainless Steel Plate.

Information Offer filed Mar. 22, 2010 in Appln. No. 2009-225218 and English translation.

Information Offer filed Feb. 17, 2010 in Appln. No. 2009-225218 and English translation.

Communication mailed Aug. 2, 2012, in connection with Chinese Patent Application No. 200510132326.0, 7 pages; Patent Office of the People's Republic of China.

Communication mailed Mar. 5, 2013, in connection with Chinese Patent Application No. 200510132326.0, 7 pages, Patent Office of the People's Republic of China, Republic of China.

* cited by examiner

FIG.1B
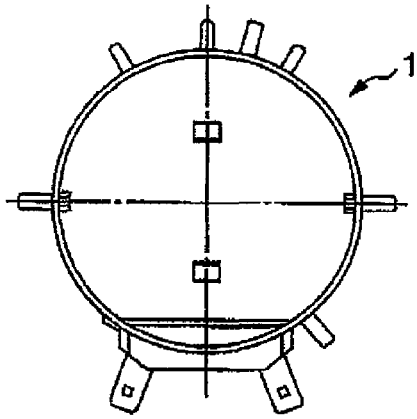
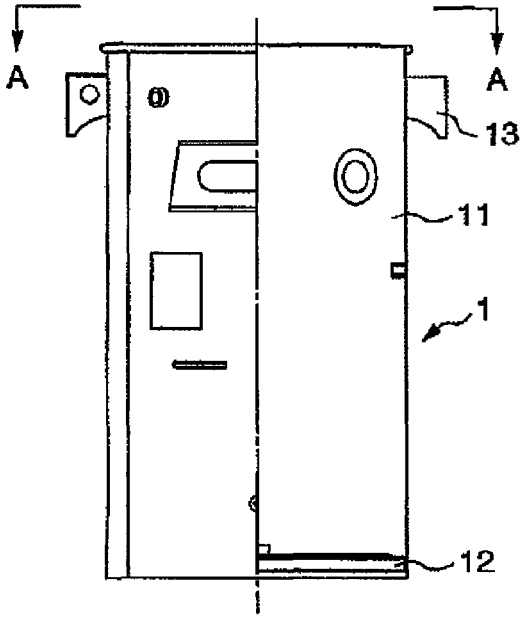
FIG.1A
FIG.1C
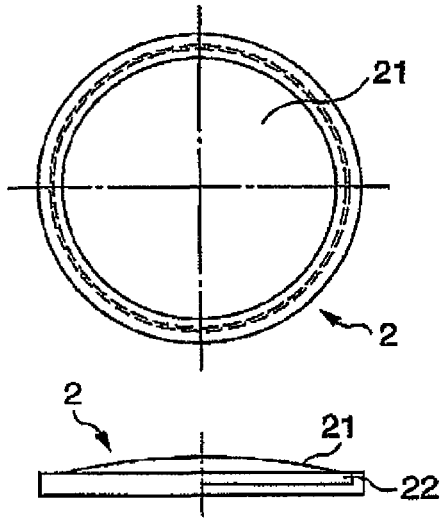
FIG.1D

POWER DISTRIBUTION TRANSFORMER AND TANK THEREFOR

CROSS-REFERENCE TO RELATED APPLICATION

This application is a Continuation application of application Ser. No. 12/915,092 filed Oct. 29, 2010, now U.S. Pat. No. 8,143,985 which is a Divisional application of U.S. application Ser. No. 11/313,830, filed Dec. 22, 2005, now U.S. Pat. No. 7,843,298 the contents of each of which are incorporated herein by reference.

INCORPORATION BY REFERENCE

The present application claims priority from Japanese application JP2004-375208 filed on Dec. 27, 2004, the content of which is hereby incorporated by reference into this application.

BACKGROUND OF THE INVENTION

The present invention relates to a material and a manufacturing method of a tank of an oil-immersion type power distribution transformer for indoor and outdoor use.

PRIOR ART

FIG. 2 is a schematic drawing showing a configuration of an oil-immersion type transformer a body of which is contained in a metallic tank so as to be disposed on an outdoor pole and in an electric room and so on. An inner structure consisting of an iron core 4 and a coil 3 is contained in the tank 1 to which a bushing 6 is attached. Insulation oil 5 is filled in the tank, and a top of the tank is closed by a lid 2. The tank 1 is an assembled structure of steel plates welded with one another so as to prevent the insulation oil from leaking through weld seams. Further, in order to enhance the rust-proof characteristic of the tank and to improve the finish appearance of the same, the whole surface of the tank is coated with a paint having excellent weather resistance.

SUMMARY OF THE INVENTION

In the oil-immersion type power distribution transformer for indoor and outdoor use, however, it is difficult to provide the tank made of plain steel with perfect rust-proof characteristic, so that occurrence of rust in various parts of the tank with the lapse of time is an unavoidable phenomenon. As a result, there is a possibility that when the progress of the rust is remarkable, a hole is made in the steel plate to cause the insulation oil contained in the tank to leak. In the case of the transformer mounted on the outdoor pole and so on, the land under the transformer is often a private one, so that occurrence of oil leakage may cause to pollute the soil of general private land. Further, in the case where oil leakage occurs in a transformer disposed in a room, oil may flow out through distributing water pipes and the like, thereby causing water of rivers and the sea to be polluted. Since each of the above described events of oil leakage may become a general social problem, the owner of the transformer is required to confirm the deterioration state of the tank by the periodic inspection and the like, in order to avoid the occurrence of such events.

The present invention has been proposed in view of the above technical background.

A problem to be solved by the present invention is to provide an oil-immersion type power distribution transformer for indoor and outdoor use, of which tank can be manufactured by substantially the same manner as that of a transformer tank with plain steel, and has good weather resistance such as rust-proof characteristic until about the end of the life of the transformer.

In order to solve the above problem, according to one feature of the present invention, there is provided a power distribution transformer comprising a body of the transformer, the body consisting of a coil and an iron core; a tank containing the body of the transformer and an insulation substance which fills an inner space of the tank; and an upper lid of the tank, wherein the tank is made of a ferritic stainless steel.

In the power distribution transformer, it is possible for the tank to have good characteristics in weather resistance and workability with utilization of the ferritic stainless steel.

According to another feature of the present invention, there is provided a power distribution transformer comprising a body of the transformer, the body consisting of a coil and an iron core; a tank containing the body of the transformer and an insulation substance which fills an inner space of the tank; and an upper lid of the tank, wherein the upper lid is made of a ferritic stainless steel.

In the power distribution transformer, it is possible for the upper lid to have good characteristics in weather resistance and workability with utilization of the ferritic stainless steel.

Other objects, features and advantages of the invention will become apparent from the following description of the embodiments of the invention taken in conjunction with the accompanying drawings.

BRIEF DESCRIPTION OF THE SEVERAL VIEWS OF THE DRAWINGS

FIG. 1A is a partially broken away schematic front view of a transformer tank;

FIG. 1B is a view indicated by an arrow line A-A in FIG. 1A;

FIG. 1C is a plan view of an upper lid of the transformer tank shown in FIG. 1A;

FIG. 1D is a side view of the upper lid shown in FIG. 1C;

DETAILED DESCRIPTION OF THE INVENTION

Figure 2:
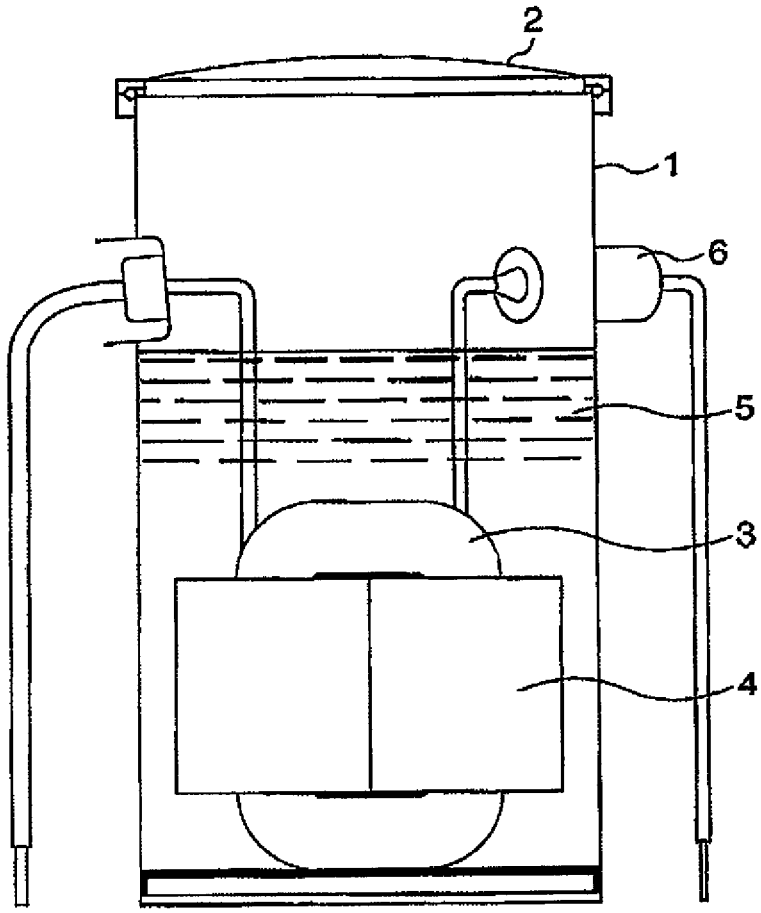
FIG. 2 is a schematic cross-sectional view showing a structure of the transformer.

Herein below there will be provided a description of embodiments of a power distribution transformer and a transformer tank according to the present invention. FIG. 1 is a schematic view of a structure of a transformer tank, and FIG. 2 is a schematic view of a structure of a transformer.

Example 1

The structure of the power distribution transformer according to Example 1 will be described with reference to FIGS. 1A to 1D and FIG. 2. A tank 1, which contains an inner structure of an iron core 4 and a coil 3, and which is filled with insulation oil 5, comprises a side wall 11, produced by forming a flat steel plate into a cylindrical shape, and a disc-like bottom wall 12. Depending upon specifications for production and uses, various kinds of metal attachments (e.g. a member 13) are provided on the outer and inner surfaces of the tank. The side wall 11 and the bottom wall 12 are made of a ferritic stainless steel. Alternatively, either one of the side wall 11 and the bottom wall 12 may be made of the ferritic stainless steel. Further, only specific parts of the side wall 11 and the bottom wall 12 may be made of the ferritic stainless steel.

The ferritic stainless steel has tensile and bending properties similar to those of a plate of plain steel, unlike austenitic stainless steels represented by Fe-18Cr-8Ni. The use of the ferritic stainless steel makes it possible to remarkably improve pitting corrosion resistance without modifying an existing manufacturing equipment and the shape of the tank to a large extent. Further, the ferritic stainless steel contains Cr in an enough amount to be self-passivated in the atmospheric environment thereby having pitting corrosion resistance when a surface treatment layer such as a coating film and a plating film is worn out, and also defective parts of surface treatment layer. Further, even when the surface treatment layer loses the corrosion protective function and the ferritic stainless steel is corroded to generate red rust, the self-passivation easily occur under the rust layer, resulting in a phenomenon in which the rust is generated but the progress of erosion due to pitting corrosion is extremely slow. For this reason, the ferritic stainless steel has an excellent property for preventing an accident that there arises a leak of the content from the tank. Further, since the ferritic stainless steel does not contain a much amount of Ni, it has an excellent adhesion property for coating painting or plating. For this reason, the ferritic stainless steel can be easily subjected to a rust prevention surface treatment, such as coating and plating, not like as austenitic stainless steel containing a much amount of Ni. Further, although stress corrosion crack occurs in austenitic stainless steel by chloride ions ($Cl^-$), it rarely occurs in ferritic stainless steel. Thus, the ferritic stainless steel is a preferable material of the tank which may be used in a marine outdoor environment in which sea wind is blown to make sea salt attached to the tank.

The ferritic stainless steel contains not less than 11 mass % Cr. However, in the cases where occurrence of rust is allowed, where painting is applied on the surface as a primary rust prevention treatment, and further where the cost reduction for structural material steel is needed, it is possible to use the ferritic stainless steel which contains not less than 7.0 mass % Cr, and which has a metal structure having not less than 60 volume % of a ferrite phase.

Example 2

Referring to FIGS. 1A to 1D and FIG. 2, a description will be provided with regard to a configuration of a distribution transformer of Example 2. The upper lid 2 of the transformer tank has a structure in which various types of metal attachments (see reference numeral 22, for example) are attached to the cover 21 being made of the ferritic stainless steel. Only specific parts of the cover 21 may also be made of the ferritic stainless steel.

Example 3

Referring to FIGS. 1A to 1D and FIG. 2, a description will be provided with regard to a configuration of a distribution transformer of Example 3. In the power distribution transformer described in Example 1 or 2, all or specific components of metal attachments (see reference numeral 13, for example) fixed to the body of the tank 1 and of metal attachments (see reference numeral 22, for example) fixed to the upper lid 2 are made of the ferritic stainless steel. Only specific parts of the components may also be made of the ferritic stainless steel.

Example 4

Herein a description will be provided with regard to a power distribution transformer of Example 4. In the power distribution transformer described in any one of Examples 1 to 3, a particular ferritic stainless steel is used, which has properties of not less than 30% of fracture elongation when subjected to uniaxial stretching, and of not less than 1.1 of the Lankford value (r-value). If the fracture elongation and the r-value of a ferritic stainless steel are small, the steel is difficult in subjecting to a forming process, even when it has the same proof stress and tensile strength as those of plain steel. Thus, in the case where there is a need for saving the production cost, and when an article, which has the same shape as that of an existing article made of plain steel or another article having a complicated shape, is produced, it is advantageous to use the ferritic stainless steel having the above characteristics.

Example 5

Herein a description will be provided with regard to a power distribution transformer of Example 5. In the power distribution transformer described in any one of Examples 1 to 4, a particular ferritic stainless steel is used, which has the Vickers hardness (Hv) of not more than 175 and the yield ratio (YR) of not more than 80%. In the case where a ferritic stainless steel has a low hardness and a low yield ratio, it is easy for the steel to be subjected to a forming process. In the case where the ferritic stainless steel has the low yield ratio, it exhibits excellent fracture resistance property when an impact is exerted on the steel due to dropping to the ground, for example. Thus, when a transformer tank, which has a complicated shape or is required to have good fracture resistance property, it is advantageous to use the ferritic stainless steel having the Vickers hardness of not more than 175 and the yield ratio of not more than 80%.

Example 6

Herein a description will be provided with regard to a power distribution transformer of Example 6. The power distribution transformer described in any one of Examples 1 to 5, is made of a ferritic stainless steel containing 7.0 to 14.0 mass % Cr. The additive Cr in the ferritic stainless steel has an effect that a dense passive state film is formed on the surface of the steel by air oxidation whereby improving pitting corrosion resistance property. However, in the case where the Cr amount is excessive, not only the production cost is increased, but also the steel is deteriorated in toughness. Further, in the case of an excessive amount of Cr, a pretreatment of steel is difficult since the adhesion property needed for a primary rust prevention treatment, such as painting, is deteriorated. Thus, in the case where the toughness (especially, the low-temperature toughness at a heat affected zone due to welding) is needed or where the adhesion with the surface treatment layer is required, it is advantageous to use the ferritic stainless steel containing 7.0 to 14.0 mass % Cr.

Example 7

Herein a description will be provided with regard to a power distribution transformer of Example 7. In the power distribution transformer described in any one of Examples 1 to 6, used is a ferritic stainless steel containing at least one element selected from the group consisting of 0.08 to 2 mass % Ti, 0.08 to 2 mass % Nb and 0.01 to 1 mass % Al.

The elements of Ti, Nb and Al have an effect to improve the pitting corrosion resistance property of the ferritic stainless steel. Particularly, the elements improve properties of the rust resistance and the pitting corrosion resistance to chloride ions ($Cl^-$) in a state where scales produced by welding is left unremoved. Thus, in the use in a severely corrosive environment, it is preferred to use the ferritic stainless steel containing at least one element selected from the group consisting of 0.08 to 2 mass % Ti, 0.08 to 2 mass % Nb and 0.01 to 1 mass % Al. In the case of insufficient amounts of the additive elements, the expected effect is small. However, if those amounts are excessive, the steel characteristics matching to the cost can not be obtained.

Example 8

Herein a description will be provided with regard to a power distribution transformer of Example 8. The power distribution transformer described in any one of Examples 1 to 7, is made of a ferritic stainless steel containing at least one element selected from the group consisting of 0.08 to 2 mass % Ni, 0.08 to 2 mass % Cu, 0.08 to 2 mass % Mo and 0.08 to 2 mass % W.

The elements of Ni, Cu, Mo and W have an effect to significantly improve the pitting corrosion resistance property of the ferritic stainless steel. The effect is not limited to reduce the pitting depth, but to reduce the frequency of occurrence of pitting. Further, the elements have an effect of improving not only properties of the rust resistance and the pitting resistance to chloride ions ($Cl^-$) due to sea wind and dispersed salt on the road for snow-melting purpose, but also properties of the rust resistance and the pitting resistance to acidic gases such as sulfurous acid gas and nitrous acid gas, acid rain and acid fog. In an especially severely corrosive environment such as in a marine area, inside a tunnel and the like, it is effective to use the ferritic stainless steel containing at least one element selected from the group consisting of 0.08 to 2 mass % Ni, 0.08 to 2 mass % Cu, 0.08 to 2 mass % Mo and 0.08 to 2 mass % W. In the case where the amounts of the additive elements are insufficient, the effect is small, and in the case where the additive amounts are excessive, the steel characteristics matching to the cost can not be obtained.

Example 9

Herein a description will be provided with regard to a power distribution transformer of Example 9. The power distribution transformer, of which structural members are made of the ferritic stainless steel, described in any one of Examples 1 to 8, is produced so that a solidification structure of a weld metal contains not more than 10 volume % of a ferrite phase. In the case where the content of ferrite phase in the solidification structure of the weld metal is much, the toughness (especially the low temperature toughness) is deteriorated. Thus, in the case where a tank having an excellent impact property is required, it is effective to make the content of ferrite phase in the solidification structure of the weld metal to be not more than 10 volume % with utilization of a welding rod of austenitic steel.

Example 10

Herein a description will be provided with regard to a power distribution transformer of Example 10. The power distribution transformer described in any one of Examples 1 to 9, is produced so as to have a structure in which a clearance between opposed metal parts is filled with a weld metal, such a clearance being present on an outer surface of the tank. Various types of metal attachments, such as seats for attachments, are joined by welding on the outer surface of the tank. In this case, the metal attachments are joined by fillet welding to the side surface of the tank. However, when all the outer circumference of the contact surface is not welded and a non-welded part is left, water and saline intrude into the non-welded part to become a start point of the rust generation and the pitting corrosion. Thus, in the use in severely corrosive environment, and in the case where particularly high durability is required, it is effective to produce the tank with a structure in which a clearance between opposed metal parts is filled with a weld metal, the clearance being present on an outer surface of the tank.

Example 11

Herein a description will be provided with regard to a power distribution transformer of Example 11. The power distribution transformer described in any one of Examples 1 to 10 is produced by painting an outer surface of the tank. The paint film may be applied to the entire surface or a part of the surface of the tank. By providing the paint film to the ferritic stainless steel, the rust resistance and the pitting resistance properties can be remarkably improved. Further, with such paint film, it is possible to enable the tank to have a color compatible with natural landscapes. Since a high rust preventive property is not required to the paint film according to the present invention, the film thickness is not limited. Only in order to provide the tank with a color, a film thickness may be several micro-meter (μm). Further, with regard to the relationship between the ferritic stainless steel and the paint film, since the ferritic stainless steel has excellent corrosion resistance property and a coating film adhesion property not like as plain steel, a preliminary coating layer such as rust preventive undercoat as required in the case of plain steel is not necessary, so that a finish coating can be applied directly on the stainless steel.

Example 12

Herein a description will be provided with regard to a power distribution transformer of Example 12. The power distribution transformer described in any one of Examples 1 to 11, is produced by subjecting an outer surface of the tank to a primer treatment of electrodeposition coating prior to a painting treatment on an outer surface of the tank. The electrodeposition coating may be applied to the whole outer surface or a part of the outer surface of the tank. The electrodeposition coating has an effect of suppressing corrosion under a painting film, so that the high corrosion resistance can be exhibited by using the electrodeposition coating as a primer treatment at the time when a paint film is provided on the ferritic stainless steel. Thus, in the case where the durability for a super-long period is required in a severely corrosive environment, the electrodeposition coating is preferably applied as the primer treatment.

Example 13

Herein a description will be provided with regard to a power distribution transformer of Example 13. The power distribution transformer described in any one of Examples 1 to 12, is produced by subjecting an outer surface of the tank to a primer treatment of Zn plating. The Zn plating may be applied to the whole outer surface or a part of the outer surface of the tank. The Zn plating layer exhibits a sacrificial corrosion preventive effect on the ferritic stainless steel. In addition to this effect, corrosion products of Zn also have an effect of restraining a generation of rust and a growth of pitting in the stainless steel. Thus, in case where the durability for a extremely long term is required in a severely corrosive environment, it is effective to apply the Zn plating to the primer treatment.

Example 14

Herein a description will be provided with regard to a power distribution transformer of Example 14. In the power distribution transformer described in any one of Examples 1 to 13, components such as the upper lid 2 and the bottom wall 12 which are subjected to drawing press forming, are adjusted in their material shape before the drawing press forming, in accordance with the rolling direction of the material, and taking into consideration of the anisotropy of the ferritic steel. When preparing those components by forming, an initial material size of a member, which is bent in parallel to the rolling direction, is made smaller in length by 0.5 to 1% than that after bending, while an initial material size of another member, which is bent perpendicularly to the rolling direction, is made longer in length by 0.5 to 1% than that after bending.

Example 15

Here, a description will be provided with regard to the subject matters as defined in claims 15 to 21. First, elements used for corrosion detection need to have a same composition as that of the tank of the power distribution transformer. This is because a corrosion detector element 7 having a different material composition has a different corrosion resistance property so that an amount of erosion of an apparatus or a structure cannot be properly evaluated based on an amount of erosion of the corrosion detector element. The term of "the same composition" used in the present text means a metal composition exhibiting the same corrosion resistance property, and does not mean a metal composition having absolutely the same chemical composition. As a measure of the difference, materials even having a difference in the composition range of various kinds of standard materials specified by the Japanese Industrial Standard (JIS) and the like, can be used as the corrosion detector elements having the same material composition. In the case of chromium, materials having a difference in the composition range of not more than 1% can be handled as materials having the same composition.

The corrosion detector element 7 used for corrosion detection needs to have a base material exposure side 71 being exposed so as to directly contact with corrosion causative substances. This is to limit the reaction part (corrosion part) between the material and the environment to a specific location. Even in the case where painting and plating are applied to the tank of the power distribution transformer, it is necessary to evaluate the corrosion resistance of minute flaw parts inevitably present in the coating layers, and hence, the element used for corrosion detection needs to have a base material exposure side 71 being exposed so as to directly contact with corrosion causative substances.

Further, the corrosion detector element needs to be constituted to have two opposite sides which are of a part 72 coated with a highly corrosion resistant material and of the metal exposed part 71. This is because the amount of erosion on the metal exposed surface is measured by making a sensor section of an ultrasonic thickness gauge closely contact with the outer surface of the highly corrosion resistant material side to measure the distance between the metal exposed part 71 and the outer surface of highly corrosion resistant material. It is necessary to make the sensor section of the ultrasonic thickness gauge closely contact with an object to be measured in order to secure measurement accuracy. Thus, the rear face of the metal exposed part needs to be prevented from being corroded over a long period of time. Therefore, the rear face 72 of the metal exposed part needs to be coated with a highly corrosion resistant material.

When corrosive nature of the environment is weak, an organic coating can be used as the coating material simply at low cost. When corrosive nature of the environment is strong, the organic coating is preferably set to have a film thickness of not less than 20 μm. Instead of the organic coating, the coating layer may be of a plating layer, a primary component of which is zinc or aluminum. These plating metals have an excellent corrosion resistance in the atmospheric environment, and hence are preferably used as a erosion monitor for monitoring an outdoor apparatus and a building. Instead of the plating, the coating layer may also be of an organic coating layer containing fine particles of zinc or aluminum. The zinc and aluminum dispersed in the organic painting film excellently enhance the corrosion resistance, and hence, such organic painting is preferably used for the treatment of the non-corroding surface of the erosion monitor.

In the case where the corrosion environment is severer than the atmospheric environment, or in the case where the amount of corrosion needs to be accurately measured for a long period of time, the highly corrosion resistant material is preferably any one selected from the group consisting of stainless steel, a nickel-base alloy, pure titanium, a titanium alloy, aluminum, an aluminum alloy, copper and a copper alloy. Application of these metallic materials is especially effective in a sulfurous acid gas environment and in a coastal area where sea water is splashed on the material. Further, it is possible to provide a corrosion detector element having an extremely high reliability by providing the organic layer 75 on the surface of the plating layer, a primary component of which is zinc or aluminum, and on the surface of stainless steel, a nickel-base alloy, pure titanium, a titanium alloy, aluminum, an aluminum alloy, copper and a copper alloy.

In the use environment in which the sea salt concentration and the concentration of sulfurous acid gas are high, and in which the electric conductivity of water films formed on the surface of the corrosion detector element is high, the outer surface of the highly corrosion resistant material and the base material exposed part which directly contacts with corrosion causative substances, are preferably electrically insulated from each other. This is because the eroding speed of the base material exposed part is influenced by the galvanic corrosion. In the following, examples corresponding to claim 29 to claim 56 will be described.

TABLE 1

Figure 4:
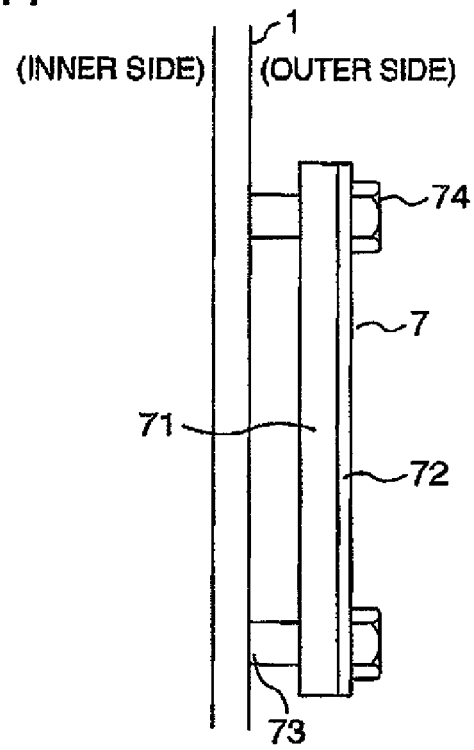
FIG. 4 is a side view of a corrosion detector element provided on the transformer tank, one surface of the corrosion detector element being coated with a highly corrosion resistant material.
Figure 5:
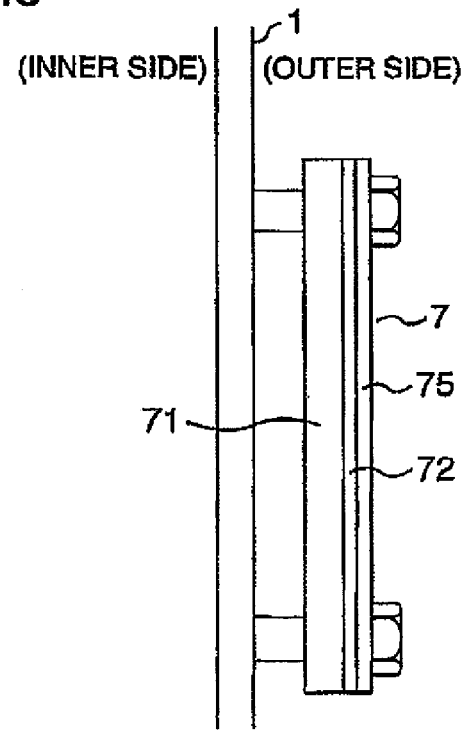
FIG. 5 is a side view of a corrosion detector element provided on the transformer tank, one surface of the corrosion detector element being coated with a highly corrosion resistant material and an organic material.
Figure 6A:
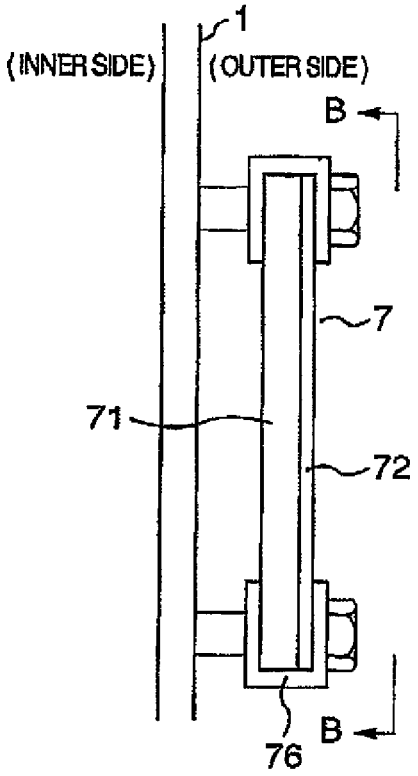
FIG. 6A is the side view of a corrosion detector element provided on the transformer tank, one surface of the corrosion detector element being coated with a highly corrosion resistant material, and an electric insulating coating being provided over an exposed portion of the corrosion detector element and the highly corrosion resistant material coating.
Figure 7:
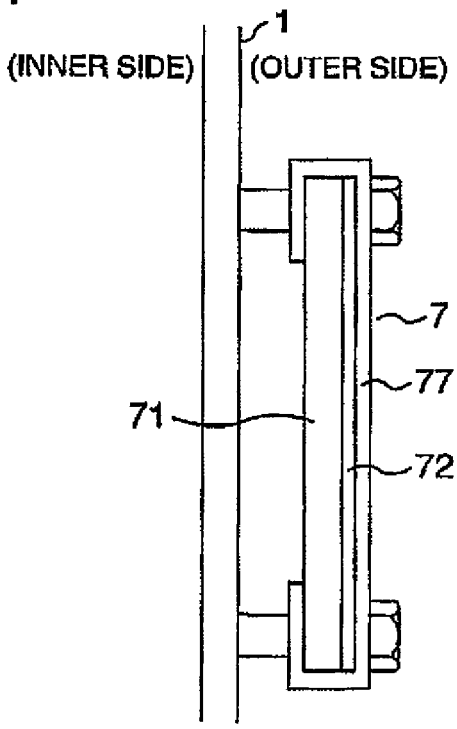
FIG. 7 is a side view of a corrosion detector element provided on the transformer tank, one surface of the corrosion detector element being coated with a highly corrosion resistant material, and further with an electric insulation organic coating.

| | Power | Corrosion detector element | | |
|---|---|---|---|---|
| No. | distribution transformer (container) Erosion depth (μm) | Highly corrosion resistant material | Form, etc. | Erosion depth by ultrasonic measurement (μm) |
| 1 | 0.35 | Acryl resin (15 μm) | FIG. 4 | 0.33 |
| 2 | 0.44 | Acryl resin (50 μm) | FIG. 4 | 0.46 |
| 3 | 0.53 | Zinc plating by hot-dipping | FIG. 4 | 0.55 |
| 4 | | Aluminum plating by hot-dipping | | 0.51 |
| 5 | 0.58 | Paint with zinc particles | FIG. 4 | 0.55 |
| 6 | | Paint with aluminum particles | | 0.59 |
| 7 | 0.65 | JIS SUS304 | FIG. 4 | 0.66 |
| 8 | | Alloy 600 | | 0.68 |
| 9 | | Pure Ti | | 0.66 |
| 10 | | Ti—6Al—4V | | 0.68 |
| 11 | | Pure Al | | 0.62 |
| 12 | | 6061Al alloy | | 0.68 |
| 13 | | Cu (pure) | | 0.66 |
| 14 | | Cu—Zn—Al | | 0.67 |
| 15 | 0.78 | Paint with zinc particles | FIG. 5 | 0.77 |
| 16 | | JIS SUS304 | | 0.80 |
| 17 | | Pure Ti | | 0.82 |
| 18 | | 6061Al alloy | | 0.74 |
| 19 | 0.85 | Paint with zinc particles | FIGS. 6A | 0.88 |
| 20 | | JIS SUS304 | and 6B | 0.89 |
| 21 | | Pure Ti | | 0.83 |
| 22 | | 6061Al alloy | | 0.81 |
| 23 | 0.98 | Paint with zinc particles | FIG. 7 | 0.99 |
| 24 | | JIS SUS304 | | 1.02 |
| 25 | | Pure Ti | | 0.93 |
| 26 | | 6061Al alloy | | 0.98 |

The tank of the power distribution transformer whose corrosion resistance was to be evaluated and the corrosion detector element were produced by combining various kinds of materials shown in the Table 1, and an accelerated atmospheric exposure test was conducted for one year, in which test the artificial seawater (ASTM D 1141-90) concentrated to be four times the original concentration was sprayed two times per day at 9 a.m. and 3 p.m. Then, the residual thickness was measured by using a commercially available ultrasonic thickness gauge and by making the sensor of the ultrasonic thickness gauge closely contact with the highly corrosion resistant material side of the corrosion detector element, so that the measured result was compared with the amount of erosion on the tank of the power distribution transformer, the corrosion resistance of which tank was an object to be evaluated.

Figure 3A:
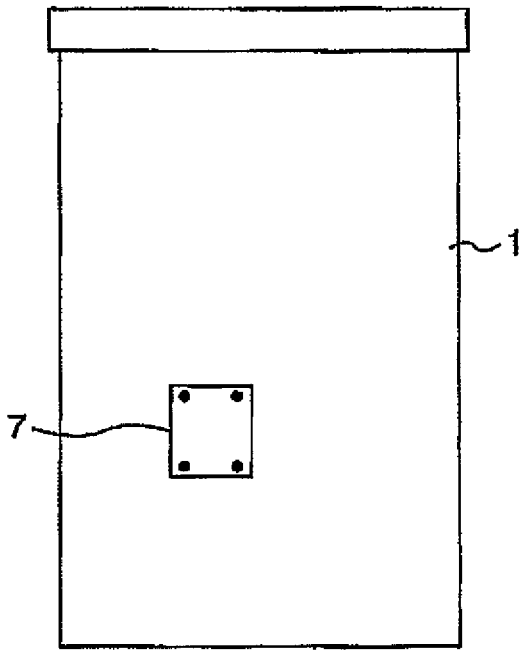
FIG. 3A is a schematic view of the transformer tank on which a corrosion detector element is provided.
Figure 3B:
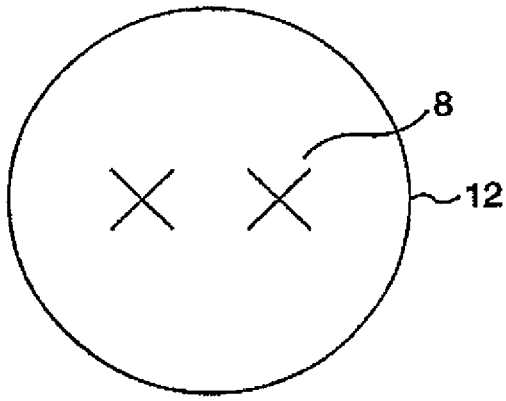
FIG. 3B shows a bottom wall of the transformer tank shown in FIG. 3A.

The tank of the power distribution transformer, the corrosion resistance of which tank was an object to be evaluated, is schematically shown in FIG. 3. The tank was constituted by a Fe-10.5% Cr-0.4% Ni steel, and a painting film of a thickness of about 10 μm was provided on the surface of the tank. The cross cuts 8 having the width of about 1 mm and the length of about 100 mm, and reaching the base metal was formed in two places (FIG. 3A and FIG. 3B). The erosion depth in these places was measured and the deepest erosion depth is taken as a representative value. Specifically, after completion of the exposure test, the periphery of the cross cuts was cut out, and the residual painting film on the cut-out part was removed by an organic solvent. Subsequently, the rust on the surface the cut-out part was removed by repeatedly making the cut-out part immersed in a 10% diammonium hydrogen citrate aqueous solution (50° C.) and subjected to nylon brush rubbing. Then, using an optical microscope, the depth of the most deeply eroded part from the original surface on which the painting film exists, was obtained so as to be taken as the erosion depth.

Noted that the severity of the corrosion environment in the accelerated atmospheric exposure test was changed by changing the amount of artificial sea water to be sprayed. The spray amount described below was the amount sprayed in each spraying operation performed at 9:00 a.m. and 3:00 p.m. Noted that the corrosion detector element was attached to the tank of the power distribution transformer so that the position at a distance of 200 mm from the bottom of the side surface of the tank becomes the lower end of the corrosion detector element, as shown in FIG. 3. The corrosion detector element was set to have the longitudinal size of 150 mm and the lateral size of 100 mm. Noted that in measuring the residual thickness of the corrosion detector element, a specific pretreatment such as removing rust formed on the base material exposed part and the like was not performed. In order to secure the close contact state between the ultrasonic sensor and the high corrosion resistant material, only a grease was applied to the surface of the sensor.

No. 1 in Table 1 denotes an embodiment corresponding to claims 29-32 according to the present invention. The corrosion detector element was produced to have a configuration shown in FIG. 4, and fixed to the power distribution transformer tank to be evaluated. That is, a Fe-10.5% Cr-0.4% Ni steel was used as the base metal, and was made to serve as the corrosion detector element by making one surface of the steel coated with an acrylic resin of about 15 μm as the highly corrosion resistant material. The artificial sea water was sprayed so as to make the amount of deposited chloride ions ($Cl^-$ ions) become about 0.1 g/m$^2$. As shown in Table 1, the amount of erosion of the power distribution transformer tank and the eroding speed measured by the corrosion detector element substantially coincide with each other.

Thereby, it can be seen that the progression degree of corrosion in the power distribution transformer tank can be diagnosed by the method according to the present invention. Noted that the fixing seats 73 and the fixing bolts 74 were used.

No. 2 denotes an embodiment corresponding to claims 33-36 according to the present invention. In order to constitute the embodiment as shown in FIG. 4, a Fe-10.5% Cr-0.4% Ni steel was also used as the base metal, and was made to serve as the corrosion detector element by providing one surface of the steel with a coating having a thickness of 50 μm and made of an acrylic resin as the highly corrosion resistant material. The artificial sea water was sprayed so as to make the amount of deposited chloride ions ($Cl^-$ ions) become about 0.5 g/m$^2$. As shown in Table 1, the amount of erosion of the power distribution transformer tank and the eroding speed measured by the corrosion detector element substantially coincide with each other. Thereby, it can be seen that the progression degree of corrosion in the power distribution transformer tank can be diagnosed by the method according to the present invention. Noted that in the corrosion detector element (No. 1) coated with a thin acrylic resin, corrosion under the painting layer of acrylic resin is caused so that the residual thickness cannot be measured by the ultrasonic thickness gauge. Thus, it can be seen that in the severely corrosive environment of high salinity and the like, the thickness of the organic coating is preferably increased.

Nos. 3 and 4 denote embodiments corresponding to claims 37-40 according to the present invention. Here, in order to constitute the embodiments as shown in FIG. 4, a Fe-10.5% Cr-0.4% Ni steel subjected to a hot-dip zinc plating (with deposited amount of 270 g/m$^2$) or a hot-dip aluminum plating (with deposited amount of 200 g/m$^2$) is also used, and made to serve as the corrosion detector element by removing the plated layer of one surface by mechanical grinding and a chemical solution. The artificial sea water was sprayed so as to make the amount of deposited chloride ions ($Cl^-$ ions) become about 1 g/m$^2$. As shown in Table 1, the amount of erosion of the power distribution transformer tank and the eroding speed measured by the corrosion detector element substantially coincide with each other. Thereby, it can be seen that the progression degree of corrosion in the power distribution transformer tank can be simply and accurately diagnosed by the method according to the present invention.

Nos. 5 and 6 denote embodiments corresponding to claims 41-44 according to the present invention. Also, in order to constitute the embodiment as shown in FIG. 4, a Fe-10.5% Cr-0.4% Ni steel is made to serve as the corrosion detector element by providing one surface of the steel with a coating having a thickness of 50 μm and made of a material made by mixing a zinc-rich paint or an acrylic resin coating material with fine particles of aluminum. The artificial sea water is sprayed so as to make the amount of deposited chloride ions ($Cl^-$ ions) become about 1 g/m$^2$. As shown in Table 1, the amount of erosion of the power distribution transformer tank and the eroding speed measured by the corrosion detector element substantially coincide with each other. Thereby, it can be seen that the progression degree of corrosion in the power distribution transformer tank can be diagnosed by the method according to the present invention.

Nos. 7 to 14 denote embodiments corresponding to claims 45-48 according to the present invention. Also, in order to constitute the embodiment as shown in FIG. 4, a clad material formed by laminating, on one surface of a Fe-10.5% Cr-0.4% Ni steel, stainless steel JIS SUS 304 (Fe-18% Cr-8% Ni), a Ni-base alloy of Alloy 600 (Ni-16% Cr-10% Fe), industrial pure titanium, a Ti-6% Al-4% V alloy (titanium alloy), industrial pure aluminum, an Al-1.0% Mg-0.5% Si-0.3% Cu (6061 aluminum alloy), industrial pure copper and an aluminum brass (Cu-22% Zn-2% aluminum alloy) by rolling method was cut and made to serve as the corrosion detector element. The artificial sea water was sprayed so as to make the amount of deposited chloride ions ($Cl^-$ ions) become about 5 g/m$^2$. As shown in Table 1, even in the highly corrosive environment, the amount of erosion of the power distribution transformer tank and the eroding speed measured by the corrosion detector element are confirmed to substantially coincide with each other. Thereby, it can be seen that the progression degree of corrosion in the power distribution transformer tank in the highly corrosive environment can be diagnosed by the method according to the present invention.

Nos. 15 to 18 denote embodiments corresponding to claims 49-52 according to the present invention. In order to constitute the embodiment as shown in FIG. 5, a Fe-10.5% Cr-0.4% Ni steel one surface of which is provided with a coating of a zinc rich paint having a thickness of about 50 μm (No. 15), and a clad material which is formed by laminating, on one surface of a Fe-10.5% Cr-0.4% Ni steel, stainless steel JIS SUS 304 (Fe-18% Cr-8% Ni), industrial pure titanium, and an Al-1.0% Mg-0.5% Si-0.3% Cu (6061 aluminum alloy) by rolling method (Nos. 16 to 18), each was cut and provided on the one surface with a coating of an acrylic resin paint 75 having a thickness of about 10 μm, so as to serve as the corrosion detector element. The artificial sea water was sprayed so as to make the amount of deposited chloride ions ($Cl^-$ ions) become about 10 g/m$^2$. As shown in Table 1, even in the highly corrosive environment, the amount of erosion of the power distribution transformer tank and the eroding speed measured by the corrosion detector element are confirmed to substantially coincide with each other. Thereby, it can be seen that the progression degree of corrosion in the power distribution transformer tank can be diagnosed by the method according to the present invention.

Figure 6B:
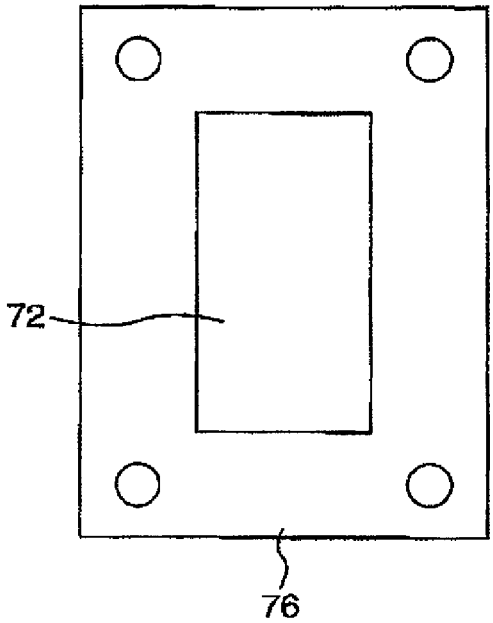
FIG. 6B is a view B-B in FIG. 6A.

Nos. 19 to 22 denote embodiments corresponding to claims 49-52 according to the present invention. In order to constitute the embodiments as shown in FIG. 6A and FIG. 6B, a Fe-10.5% Cr-0.4% Ni steel one surface of which was provided with a coating of a zinc rich paint having a thickness of about 50 μm (No. 19), and a clad material which was formed by laminating, on one surface of a Fe-10.5% Cr-0.4% Ni steel, stainless-steel JIS SUS 304 (Fe-18% Cr-8% Ni), industrial pure titanium and an Al-1.0% Mg-0.5% Si-0.3% Cu (6061 aluminum alloy) by rolling method (Nos. 20 to 22), each was cut to be formed into the shape of the corrosion detector element, and thereafter provided with an insulating coating of an acrylic resin paint 76 on its end faces and its circumference in width of about 20 mm from the end faces, so as to serve as the corrosion detector element. The artificial sea water was sprayed so as to make the amount of deposited chloride ions ($Cl^-$ ions) become about 50 g/m$^2$. As shown in Table 1, even in the highly corrosive environment, the amount of erosion of the power distribution transformer tank and the eroding speed measured by the corrosion detector element are confirmed to substantially coincide with each other. As comparison, in the case where the insulating coating is not provided on the plate surface, in the above described environmental condition, the error in the eroding speed was caused to be +25% in the case of No. 7, and the error in the eroding speed was caused to be −16% in the case of No. 14.

Nos. 23 to 26 denote embodiments corresponding to claims 53-56 according to the present invention. In order to constitute the embodiment as shown in FIG. 7, a Fe-10.5% Cr-0.4% Ni steel one surface of which is provided with a coating of a zinc rich paint having a thickness of about 50 μm (No. 23), and a clad material which is formed by laminating, on one surface of a Fe-10.5% Cr-0.4% Ni steel, stainless-steel JIS SUS 304 (Fe-18% Cr-8% Ni), industrial pure titanium, and an Al-1.0% Mg-0.5% Si-0.3% Cu (6061 aluminum alloy) by rolling method (Nos. 24 to 26), each was cut to be formed into the shape of the corrosion detector element, and thereafter provided with an insulating coating of an acrylic resin paint 77 on its end faces and the whole of the one surface, so as to serve as the corrosion detector element. The artificial sea water was sprayed so as to make the amount of deposited chloride ions ($Cl^-$ ions) become about 100 g/m$^2$. As shown in Table 1, the amount of erosion of the power distribution transformer tank to be evaluated and the eroding speed measured by the corrosion detector element are confirmed to substantially coincide with each other. Thereby, it was proved that the progression degree of corrosion in metallic apparatuses can be diagnosed by the method according to the present invention.

According to the present invention, since the transformer tank is produced with utilization of a material having an excellent weather resistance, the weather resistance property of the transformer tank can be improved and the transformer tank can be used for a long term, thereby enabling the owner of the transformer to obtain an effect of reducing the maintenance cost of the transformer. Further, since the corrosion resistance of the transformer tank can be made to be independent on painting, the painting process can be simplified or eliminated, thereby enabling a manufacturer to shorten a production time of the transformer and to obtain a cost reduction effect. Further, a product having reduced effects on the environment can be manufactured by reducing the amount of coating materials. Further, in producing the transformer tank by a manufacturer, the transformer tank can be produced by using an equipment and a working method equivalent to those in the case where plates of plain steel are used, as a result of which there is no need for making investment for new equipment and modification of existing equipment.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A power distribution transformer comprising a body of the transformer, the body comprising a coil and an iron core; and a tank containing the body of the transformer and an insulation substance which fills an inner space of the tank;

wherein the tank is made of a ferritic stainless steel having characteristics of not less than 30% elongation after fracture when subjected to uniaxial stretching, not less than 1.1 of the Langford value (r value), a Vickers hardness (Hv) of not more than 175, and a yield ratio (YR) of not more than 80%.

2. A power distribution transformer according to claim 1, further comprising an upper lid of the tank.

3. A power distribution transformer according to claim 1, wherein an outer surface of the tank is provided with a paint film.

4. A power distribution transformer according to claim 1, wherein the tank is provided with a metal attachment, and wherein the metal attachment is made of a ferritic stainless steel.

5. A power distribution transformer according to claim 1, wherein the ferritic stainless steel contains 7.0 to 14.0 mass % Cr.

6. A power distribution transformer according to claim 1, wherein a clearance between opposed metal parts is filled with a weld metal, the clearance being present on an outer surface of the tank.

7. A power distribution transformer according to claim 1, wherein a corrosion detector element is provided on the tank, wherein the corrosion detector element is made of a metal having the same chemical composition as that of a metal material of the tank, and the corrosion detector element has two opposite sides which are of a base material exposure side and a coated side with a coating layer made of a highly corrosion resistant material, the base material exposure side being exposed so as to directly contact with corrosion causative substances.

8. A power distribution transformer according to claim 7, wherein the highly corrosive resistant material is an organic material and the coating layer of the highly corrosion resistant material has a film thickness of not less than 20 μm.

9. A power distribution transformer according to claim 7, wherein the coating layer of the highly corrosion resistant material is of a plating layer a primary component of which is zinc or aluminum.

10. A power distribution transformer according to claim 7, wherein the coating layer of the highly corrosion resistant material is of an organic coating layer containing fine particles of zinc or aluminum.

11. A power distribution transformer according to claim 7, wherein the highly corrosion resistant material of the coating layer is any one selected from the group consisting of stainless steel, a nickel-base alloy, pure titanium, a titanium alloy, aluminum, an aluminum alloy, copper and a copper alloy.

12. A power distribution transformer according to claim 7, wherein there is formed an organic layer on the coating layer of the highly corrosion resistant material.

13. A power distribution transformer according to claim 7, wherein a surface of the coating layer of the highly corrosion resistant material and the exposure surface of the base material of the corrosion detector element are electrically insulated from each other.

14. A power distribution transformer according to claim 1, wherein the ferritic stainless steel contains at least one element selected from the group consisting of 0.08 to 2 mass % Ti, 0.08 to 2 mass % Nb, and 0.01 to 1 mass % Al.

15. A power distribution transformer according to claim 1, wherein the ferritic stainless steel contains at least one element selected from the group consisting of 0.08 to 2 mass % Ni, 0.08 to 2 mass % Cu, 0.08 to 2 mass % Mo, and 0.08 to 2 mass % W.

16. A power distribution transformer according to claim 1, wherein a solidification structure of a weld metal part, formed during producing the tank, contains a ferrite phase of not more than 10 volume %.

17. A power distribution transformer according to claim 1, wherein an outer surface of the tank is subjected to a primer treatment of electrodeposition coating prior to a painting treatment on the outer surface of the tank.

18. A power distribution transformer according to claim 1, wherein an outer surface of the tank is subjected to a primer treatment of Zn plating.

19. A power distribution transformer according to claim 1, wherein a component of the tank is a product produced by press forming a work which has been previously provided with a specific form in accordance with material properties of the ferritic stainless steel.

20. A tank of a power distribution transformer, in which a body of the transformer, the body comprising a coil and an iron core, is contained, and an insulation substance is filled in the inner chamber of the tank containing body of the transformer, wherein the tank is made of a ferritic stainless steel having characteristics of not less than 30% elongation after fracture when subjected to uniaxial stretching, not less than 1.1 of the Lankford value (r value), a Vickers hardness (Hv) of not more than 175, and a yield ratio (YR) of not more than 80%.

21. A tank according to claim 20, further comprising an upper lid.

22. A tank according to claim 20, wherein an outer surface of the tank is provided with a paint film.

* * * * *